US008397866B2

(12) United States Patent
Townend et al.

(10) Patent No.: US 8,397,866 B2
(45) Date of Patent: Mar. 19, 2013

(54) ENCLOSED TRACK SYSTEM FOR A FALL PROTECTION SYSTEM

(75) Inventors: Andy Townend, Houston, TX (US); Robert A. Ross, Houston, TX (US)

(73) Assignee: Flexible Lifeline Systems, Inc., Houston, TX (US)

( * ) Notice: Subject to any disclaimer, the term of this patent is extended or adjusted under 35 U.S.C. 154(b) by 207 days.

(21) Appl. No.: 12/607,741

(22) Filed: Oct. 28, 2009

(65) Prior Publication Data

US 2010/0078262 A1 Apr. 1, 2010

Related U.S. Application Data

(63) Continuation-in-part of application No. 29/298,603, filed on Dec. 7, 2007.

(51) Int. Cl.
*A62B 35/00* (2006.01)
*A62B 99/00* (2009.01)

(52) U.S. Cl. ..... 182/36

(58) Field of Classification Search ..... 182/36; 104/94, 95

See application file for complete search history.

(56) References Cited

U.S. PATENT DOCUMENTS

| | | | | |
|---|---|---|---|---|
| 339,257 | A * | 4/1886 | Bierbach | 104/94 |
| 3,870,122 | A * | 3/1975 | Faucheux | 182/36 |
| 4,125,908 | A | 11/1978 | Vail et al. | |
| 4,271,927 | A | 6/1981 | Brown et al. | |
| 4,841,871 | A | 6/1989 | Leibowitz | |
| D440,023 | S | 4/2001 | Morhaus | |
| 6,269,904 | B1 * | 8/2001 | Morhaus | 182/36 |
| 6,966,501 | B2 * | 11/2005 | Wubben et al. | 239/168 |
| 7,303,049 | B1 | 12/2007 | Greenlee | |
| 7,603,952 | B2 * | 10/2009 | Vetesnik | 104/106 |
| 7,992,680 | B2 * | 8/2011 | Small | 182/36 |
| 7,993,248 | B1 * | 8/2011 | Rasmussen | 482/69 |
| 2002/0179368 | A1 * | 12/2002 | Evangelista | 182/3 |
| 2007/0017741 | A1 | 1/2007 | Martinez et al. | |
| 2008/0202849 | A1 * | 8/2008 | Russo et al. | 182/3 |

* cited by examiner

*Primary Examiner* — Alvin Chin Shue
(74) *Attorney, Agent, or Firm* — Baker & McKenzie LLP

(57) ABSTRACT

Embodiments of the invention provide a fall protection system having first and second truss members, at a first distance from each other; first and second slotted housings at a second distance from each other, each housing defining a first track therein; a first plurality of connecting members connecting the first truss member to the first housing; a second plurality of connecting members connecting the second truss member to the second housing; and a first plurality of cross members connecting the first housing to the second housing. Some fall protection systems include at least two spaced apart support members and may have a length ranging from about 10 feet to about 2,000 feet in length.

9 Claims, 5 Drawing Sheets

ENCLOSED TRACK SYSTEM FOR A FALL PROTECTION SYSTEM

PRIOR RELATED APPLICATIONS

This application is a continuation-in-part of application Ser. No. 29/298,603, filed on Dec. 7, 2007.

FEDERALLY SPONSORED RESEARCH STATEMENT

Not applicable.

REFERENCE TO MICROFICHE APPENDIX

Not applicable.

FIELD OF THE INVENTION

Embodiments of the invention are related to fall protection systems and apparatus. Particular systems and apparatus provide a dual enclosed track system that allows bypass capability.

BACKGROUND OF THE INVENTION

The fall arrest industry worldwide manufactures and installs several types of overhead fall protection systems. They are used to prevent workers from injury or death due to falls from height.

Virtually all overhead fall arrest systems consist of a full body harness, worn by the user, which is secured to the anchorage by a lanyard. The lanyard can be cable or webbing and the harness is made of webbing to distribute the fall arrest loads on the body to prevent injury.

A variety of fall protection systems are available. There are single point anchors where the user is restricted to a 30 degree cone or envelope below the anchor point. There are also linear systems whereby the lanyard is attached to a trolley or shuttle which allows the user to traverse along while maintaining constant protection. One such linear system is the "safety cable" system. The cable-based system consists of one or more cables strung between two points. A cable trolley rides on the cable anchoring the lanyard, harness and user to the cable. Another type of fall protection system, in limited commercial use today, is the trolley beam, sometimes referred to as I-Beam style system. The typical I-beam style fall protection system includes an I-beam suspended above the structure to be traversed, a trolley which rides on the horizontal web of the I-beam, and a safety harness which is worn by the worker. The trolley in the I-beam system is typically a four-wheeled device that is designed to ride on the lower leg or flange of the horizontal web of the I-beam, and includes an attachment point (typically a carabiner) to secure the lifeline to the trolley.

Due to static loads and the loads placed on the I-beam when the lanyard engages during a fall event, the I-beam is prone to distorting. Cable systems can allow a user to fall further than desired before the lanyard engages due to dynamic deflection of the cable.

The trolleys on I-beam type systems are prone to hang-ups. For example, objects such as dust, dirt, snow, and ice are prone to collect on such systems resulting in an injury hazard when the object falls off the beam, particularly when struck by the trolley. In addition, such objects present a contamination hazard of the work areas below the I-beam system, particularly in the grain industry where, for example, food-grade grain is contained in open railcars below the system. Furthermore, a swing-fall hazard is created when the trolley hangs-up and remains far behind the user instead of directly overhead.

BRIEF DESCRIPTION OF EMBODIMENTS OF THE INVENTION

In one aspect, embodiments of the invention provide a fall protection system that includes first and second truss members positioned at a first distance from each other; and first and second slotted housings, each housing defining a first track therein wherein the first and second housings are positioned at a second distance from each other. Embodiments of the fall protection system also include a first plurality of connecting members connecting the first truss member to the first housing and a second plurality of connecting members connecting the second truss member to the second housing. Embodiments also typically include a first plurality of cross members connecting the first housing to the second housing. Some embodiments include a second plurality of cross members connecting the first truss member to the second truss member.

In preferred embodiments, the first distance is greater than the second distance, but in some other embodiments, the first distance is less than the second distance.

Preferably, the truss members comprise steel tubing that may have any desirable length thereby allowing assembly or construction of systems whose length may range from about 10 feet to about 2,000 feet or more. Some particular embodiments provide a fall protection system with an overall length of about 25 feet, about 50 feet, about 75 feet, about 100 feet, about 150 feet, about 200 feet, about 250 feet, about 300 feet, about 400 feet, about 500, about 600 feet, about 750 feet, about 1,000 feet, about 1,250 feet, or about 1,500 feet in length. Thus, some first and second truss members comprise integrally formed steel tubing or construction grade steel pipe having the desired corresponding length. In other embodiments, the truss members are formed from sections of steel tubing or construction grade steel pipe of a convenient length that are joined to form the desired length. In such embodiments, the sections may have a length of 10 to 250 feet or more. In some embodiments, the segments have a length of about 20 feet, about 30 feet, about 40 feet, about 50 feet, about 60 feet, about 75 feet, about 90 feet, about 100 feet, about 125 feet, about 150 feet, about 175 feet, or about 200 feet. Thus, some embodiments of the invention may have a length ranging up to 2,000 feet with support members spaced at intervals of 10 to 200 feet or more. But the support members may be placed at any convenient interval. Embodiments of the invention include systems wherein the support members are spaced at intervals of about 20 feet, about 30 feet, about 40 feet, about 50 feet, about 60 feet, about 75 feet, about 90 feet, about 100 feet, about 125 feet, about 150 feet, or about 175 feet.

In some embodiments, the first and second housings also comprise steel tubing. Preferably, the housing is formed by steel tubing having a slot along the longitudinal dimension of the tube. The slot defines flanges of the housing and the tracks are defined by the flanges in each housing. Preferably, the truss members are integrally formed.

Some embodiments of the invention include at least two spaced-apart support members configured to attach to one or more truss members. Typically, truss members are supported on at least two support members. Where the truss members are supported on the support members, some embodiments employ a reinforcing plate (not shown) to secure the truss members to the support members. The reinforcing plate typically has a width greater than the width of the truss member and is attached to the underside of the truss members, preferable by welding. A bolt, screw, or other type of fastening means may be used to secure the reinforcing plate to the top of the support members. In other embodiments, the truss members may be directly attached to the top of the support members. In other embodiments, the truss members may be suspended from the support members in any convenient manner. Any support member may be used. Some support members are affixed to a structure such as a building, wall, or scaffolding. Other support members are free-standing support members, said support members including a substantially vertical portion and an extending portion extending from the vertical portion over a work area. Typical free-standing support members are selected from inverted L-gallows, two-track inverted L-gallows, T-gallows, I-gallows, columns and pillars.

Some embodiments of the fall protection systems described herein include one or more trolleys that are configured to be slideable through the housings along the track therein. Typically, each trolley is connected to a lanyard that is in turn connected to a harness. Any harness configuration suitable for supporting a user in a fall may even be used.

DETAILED DESCRIPTION OF EMBODIMENTS OF THE INVENTION

The following description illustrates embodiments of the invention by way of example and not by way of limitation. Thus, the embodiments described below represent preferred embodiments of the invention. All numbers disclosed herein are approximate values unless stated otherwise, regardless of whether the word "about" or "approximately" is used in connection therewith. The numbers may vary by up to 1%, 2%, 5%, or sometimes 10 to 20%. Whenever a numerical range with a lower limit, $R_L$, and an upper limit $R_U$, is disclosed, any number R falling within the range is specifically disclosed. In particular, the following numbers R within the range are specifically disclosed: $R=R_L+k*(R_U-R_L)$, where k is a variable ranging from 1% to 100% with a 1% increment, i.e., k is 1%, 2%, 3%, 4%, 5%, . . . , 50%, 51%, 52%, . . . , 95%, 96%, 97%, 98%, 99%, or 100%. Moreover, any numerical range defined by two numbers, R, as defined above, is also specifically disclosed.

As used herein, the term integrally formed shall be interpreted to mean that the identified component is formed as a monolithic structure or as a unitary whole. Nevertheless, an integrally formed component may be composed of several essentially identical parts, such as tubing or pipe segments, that are connected together to form the overall component. Steel rod or bar may also be integrally formed. Likewise, any components that are welded together, such as a square or rectangular pipe formed by welding together four initially separate sheet-shaped sections, or where components such as individual tubing or pipe segments connect via a male/female style interconnect or other interlocking mechanism shall be considered to be "integrally formed."

Figure 1:
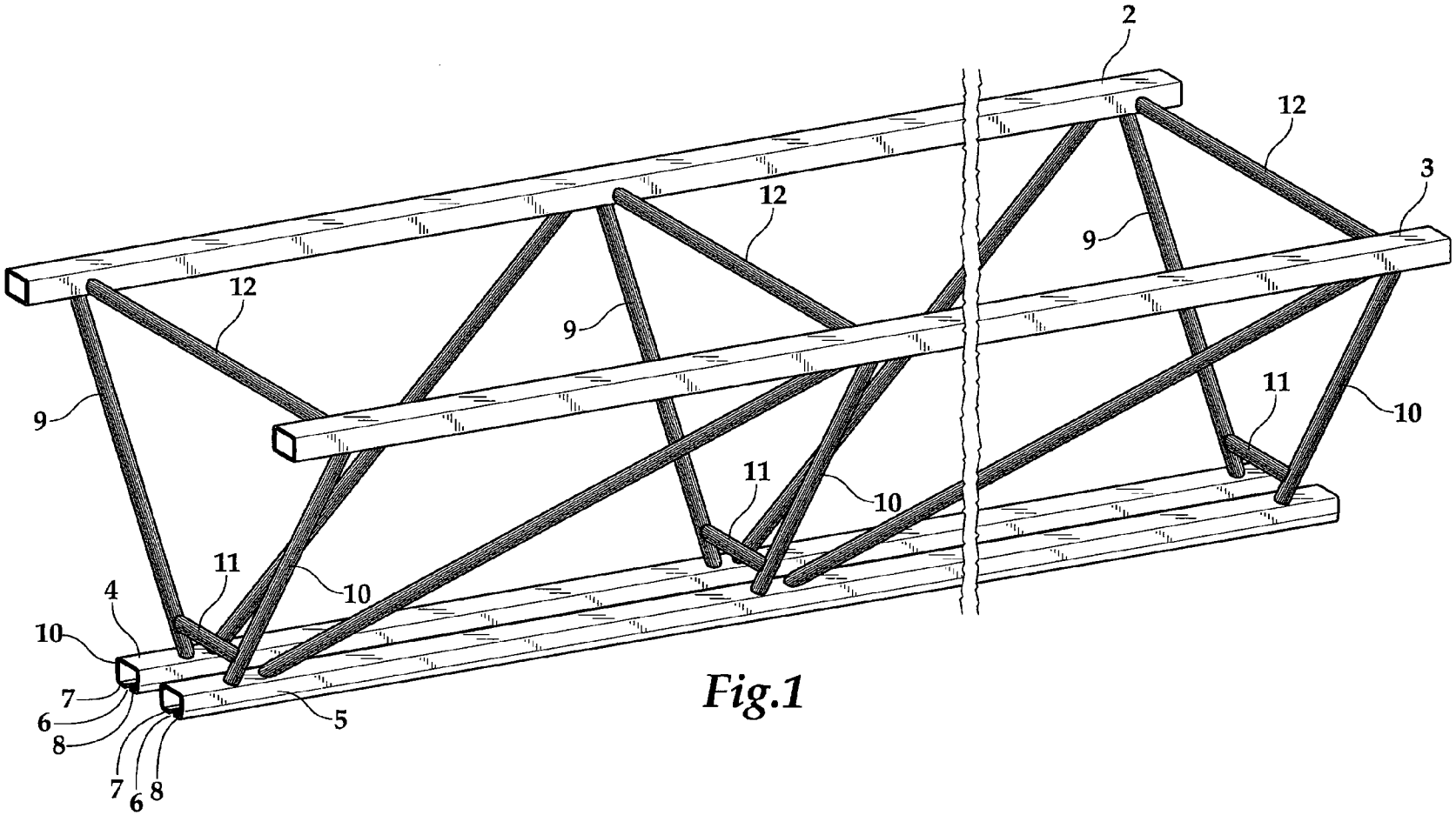
FIG. 1 schematically illustrates a fall protection system according to one embodiment of the invention.

FIG. 1 illustrates a fall protection system 1 according to an embodiment of the invention. The fall protection system includes a first truss member 2 and a second truss member 3. Truss member 2 and truss member 3 are positioned at any convenient distance from each other and typically although not necessarily lie in a horizontal plane. The truss members 2 and 3 can be made of any suitable material, such as stainless steel, titanium or a high strength steel, but typically comprises galvanized steel. The truss member 2 can be formed or constructed in any desirable manner. In some embodiments, the truss members 2 and 3 are integrally formed. In particular embodiments, truss member 2 comprises one or more sections of angle, tube, pipe, round bar or square bar. Preferably, each such section is at least about 25 to about 50 feet long. Where individual sections are employed, the sections may be joined by welding or by an interlocking mechanism wherein one section has a so-called "male" end that can be connected with the so-called "female" end of an adjacent section. In preferred embodiments, truss members 2 and 3 each comprise a single tube or pipe.

Embodiments of the invention also include housings 4 and 5. Housings 4 and 5 typically comprise stainless steel, titanium or a high strength steel. Preferably, housings 4 and 5 comprise galvanized steel. Like the truss members 2 and 3, housings 4 and 5 may be integrally formed and in particular embodiments comprise one or more sections of the tube, pipe, round bar or square bar joined together by welding or interconnecting, as described with respect to the truss members 2 and 3. Preferably the housings 4 and 5 comprise a roll-formed section of construction grade steel or other suitable material. Each of the housings 4 and 5 include a slot 6 along the longitudinal dimension of the housing. The slots 6 may be formed in any manner so long as it allows access to the interior portion of the tubing or pipe that forms the housings 4 and 5. The slot 6 forms flanges 7 and 8 in the housings 4 and 5. Typically, the slots 6 and the flanges 7 and 8 are provided along the lower portion of the tube or pipe that forms the housings 4 and 5. But in other embodiments, the slots 6 may be located in the side portions of the housings 4 and 5.

The housings 4 and 5 may be positioned at any convenient distance from each other. Preferably, the distance between the housings 4 and 5 is less than the distance that separates the truss members 2 and 3. More preferably, the distance between housings 4 and 5 is sufficient to provide by-pass capability such that the users can walk past each other without the requirement to disconnect from the fall protection system to pass each other. The distance between housings 4 and 5 generally ranges from about 6 inches to about 3 feet. Most preferably, the truss members 2 and 3 and the housings 4 and 5 form a substantially trapezoidal configuration. Typically, in such a trapezoidal configuration the truss members 2 and 3 will lie in a first horizontal plane and the housings 4 and 5 lie in a second horizontal plane. In other embodiments, the plane containing the truss members 2 and 3 need not be horizontal. Likewise, the plane of the housings 4 and 5 may also be other than horizontal. In other embodiments, the truss members 2 and 3 and housings 4 and 5 may follow any desired curvature or path, particularly where the fall protection system is attached to a structure such as a building, ceiling, or scaffolding.

Truss member 2 is connected to housing 4 by a plurality of connecting members 9. Connecting members 9 are made from any suitable material, such as stainless steel, titanium or a high strength steel. Like the truss members 2 and 3 and housings 4 and 5, the connecting members 6 typically comprise galvanized steel. The connecting members 9 may be in the form of tubing or be solid supports according to design specifications. Any configuration of the connecting members may be used. Typically, each of the connecting members 9 run perpendicularly from the truss member 2 to the housing member 4. Thus, the angle $\alpha$, formed by the truss member 2 and the connecting members 9 is typically about 90°. In other embodiments, the cross members 9 individually form any other suitable angle with the truss member 2. In other embodiments, the connecting members 9 may alternate, forming a zigzag arrangement in connecting the truss 2 to the housing 4. The connecting members 6 may be spaced at any convenient distance that provides suitable structural support for the housing 4. Preferably, the distance between the connecting members 9 prevents or minimizes swaying of the fall protection system. One suitable distance between perpendicular connecting members 9 is about 3 feet where the span of the fall protection system 1 is about 75 to 100 feet. Of course, one of ordinary skill in the art readily understands that this distance will vary to some degree based on the span of the fall protection system 1. The connecting members 9 may be attached to the truss member 2 and the housing 4 by any suitable means such as welding, or fastening with bolts, screws, or rivets. Truss member 3 is connected in any of the above manners to housing 5 by a second plurality of connecting members 10. Connecting members 10 can have any configuration or be made from materials as described above for the connecting members 9. Typically, connecting members 10 are the same length as connecting members 9. Such configurations are useful where the housings 4 and 5 are located at the distance from the respective trusses 2 and 3. But where the housings 4 and 5 are located at different distances from their respective trusses 2 and 3, the length of the connecting members 10 may be longer or shorter than connecting members 9.

Embodiments of the fall protection system 1 also typically include a plurality of cross members 11 connecting housings 4 and 5. Like the connecting members 9 and 10, the cross members 11 may connect the housings 4 and 5 in any convenient configuration. In particular embodiments, the cross members 11 form a 90° angle with respect to the longitudinal axis of the housing 4 or 5. The cross members 11 need not be directly connected to the housings 4 and 5. In other embodiments, the individual cross members may be attached to the housings 4 and 5 to form a zigzag pattern of individual cross members 11. Embodiments where the connecting members 11 are attached to connecting members 9 and 10 should also be considered as connecting the housings 4 and 5. The cross members 11 may be attached to the housings 4 and 5 directly (including via the connecting members 9 and 10) by any suitable means such as welding, or fastening with bolts, screws or rivets.

In some embodiments, the fall protection system 1 optionally includes a second plurality of cross members 12 connecting truss members 2 and 3. Cross members 12 may connect to the truss members 2 and 3 in any convenient manner or configuration and are attached by any suitable means. While the cross members 12 may be used in any desirable situation, the cross members are particularly useful where the truss members 2 and 3 are supported by support members (described below) rather than being attached to a stationary structure, such as a wall, ceiling, or scaffolding.

Figure 2:
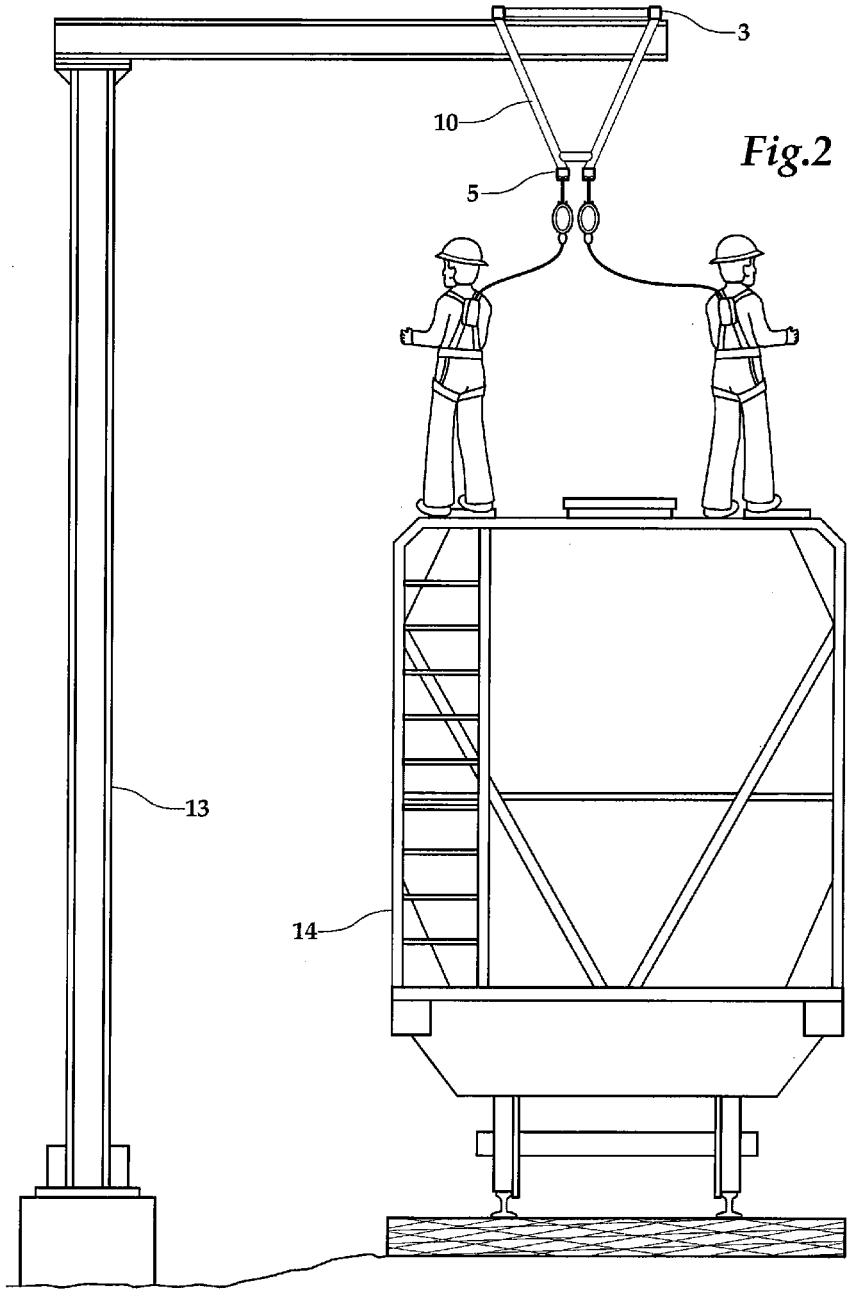
FIG. 2 schematically illustrates a fall protection system including a trolley and harness according to another embodiment of the invention.

As illustrated in FIG. 2, the fall protection system 1 may be supported by support members 13. In particular embodiments, the fall protection system 1 comprises at least two spaced apart support members 13. In such embodiments, each of the two support structures 13 is located proximately to an opposite end of the fall protection system 1. Where more than two support members 13 are employed, the support members 13 are spaced at least about 10 feet apart. In some embodiments, the support members 13 may be at least about 45 to about 50 feet apart. In still other embodiments, the support members 13 may be about 75 to about 100 feet apart. In yet other embodiments, the support members 13 may have a spacing of more than 100 to 125 or 125 to 150 feet. A support member 13 is typically placed at a distance from one end of the fall protection system 1 not exceeding 45% of the overall length of the system 1. In other words, in an embodiment where the overall length of the tubular truss members 2 and 3 is 160 feet, a support member 13 would be placed at each end not more than about 72 feet from at least one of the ends of the truss members 2 and 3. Typically, a support member 13 is placed at a distance from an end of the system 1 not exceeding about 35% to about 40% of the overall length of the system 1. In other embodiments, the distance of the support member 13 from the end of the fall protection system 1 may be 0%, about 5%, about 10%, about 15%, about 20% or about 25% of the overall length of the system 1. Typically, the overall length of the system 1 is the length of the truss members 2 and 3 or the housing members 4 and 5.

Any support member 13 may be used provided that it has a strength stiffness to support the structure in the event of a fall. Support members 13 preferably are free-standing supports which are anchored in the ground adjacent a structure 14 (such as a railcar, hopper, silo, building, etc.) on which personnel will be working. Some suitable support members include, but are not limited to, inverted L-gallows, two-track inverted L-gallows, T-gallows, I-gallows, columns and pillars. In other embodiments, the support structures 13 comprise a tubing, pipe, or any type of construction beam.

Whatever type or configuration of support members 13 are selected, the support members 13 may support the truss members 2 and 3 or in some embodiments, the truss members 2 and 3 may be suspended from the support members 13. Where the truss members 2 and 3 are suspended from the support, a bracket assembly may be used. Any suitable bracket assembly may be used. In some preferred embodiments, the truss members 2 and 3 attached to or placed on top of the support members 13. In other embodiments, the support members 13 are integrally formed with the truss members 2 and 3. The support members 13 may be attached to the truss members 2 and 3 by any convenient means, including welding, or fastening with bolts, screws, or rivets.

Figure 3:
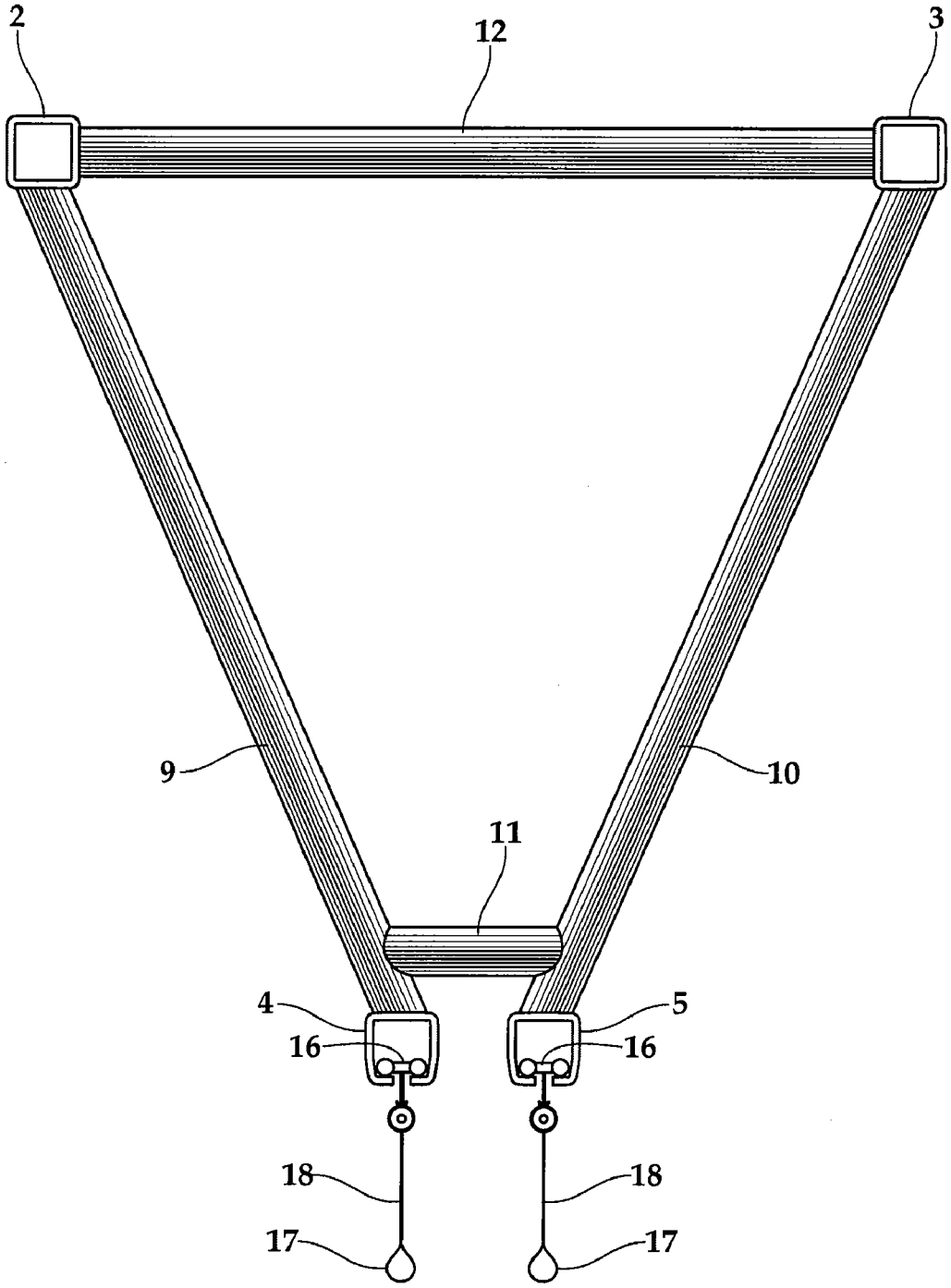
FIG. 3 schematically illustrates a fall protection system according to another embodiment of the invention.

As depicted in FIG. 3, some embodiments of the fall protection structure also include at least one trolley 16, at least one harness 17, and at least one lanyard 18 connecting the trolley 16 to the harness 17. Typically, such embodiments include one trolley 16, harness, 17 and lanyard 18 for each housing 4 and 5 that is present in the system 1. Trolley 16 is configured to be slideable along the flanges 7 and 8 of the housings 4 and 5. Preferably, the trolley includes wheels 19 which enable the trolley to move freely through the housing. Preferred trolleys 16 are commercially available, sealed bearing, Teflon-wheeled trolleys. The trolley 16 generally includes a mounting ring 20, such as a carabiner, to which the lanyard 18 is connected at one end. The lanyard 18 can be retractable or of a fixed length. The harness 17 may be of any suitable design, such as but not limited to, a safety vest or belt, and is connected to the opposite end of the lanyard 17.

Figure 4:
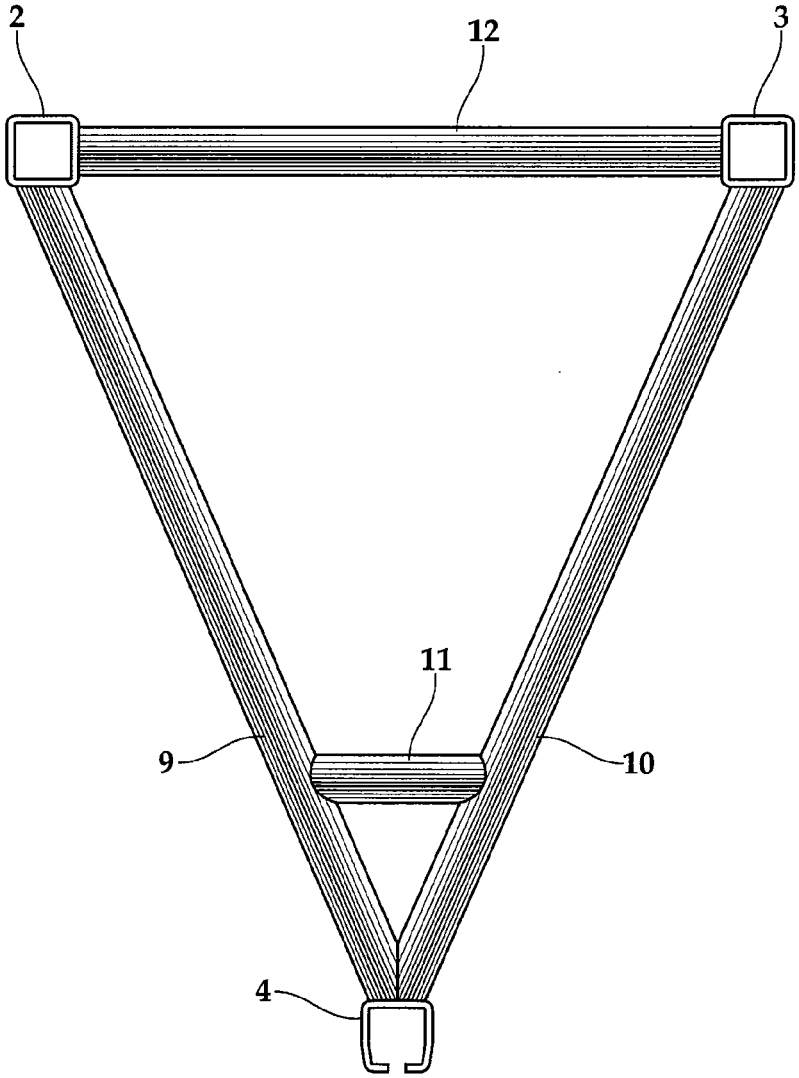
FIG. 4 through FIG. 9 schematically illustrate a fall protection system according alternate embodiments of the invention.
Figure 5:
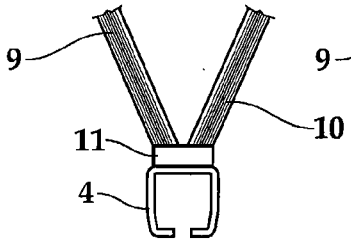
Figure 6:
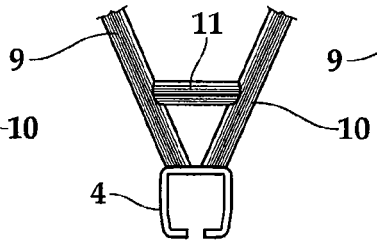
Figure 7:
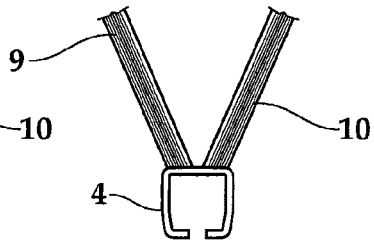

As depicted in FIGS. 4 through 7, alternate embodiments of the fall protection system 1 may include housing 4 and some combination of truss members 2 and 3, connecting members 9 and 10, and cross members 11 and 12. FIG. 4 depicts the connecting members 9 and 10 having a triangular shape and connected to each other, as well as with cross member 11. The housing 4 is directly connected to connecting members 9 and 10. The cross member 11 may be optional. FIG. 5 depicts the connecting members 9 and 10 having a triangular shape and including cross member 11. The housing 4 is directly connected to cross member 11 which is directly connected to connecting members 9 and 10. There is some separation between connecting members 9 and 10. FIG. 6 depicts the connecting members 9 and 10 having a triangular shape including cross member 11. The housing 4 is directly connected to connecting members 9 and 10. Cross member 11 connects connecting members 9 and 10. There is some separation between connecting members 9 and 10. FIG. 7 depicts the connecting members 9 and 10 having a triangular shape without cross member 11. The housing 4 is directly connected to connecting members 9 and 10. There is some separation between connecting members 9 and 10.

Figure 8:
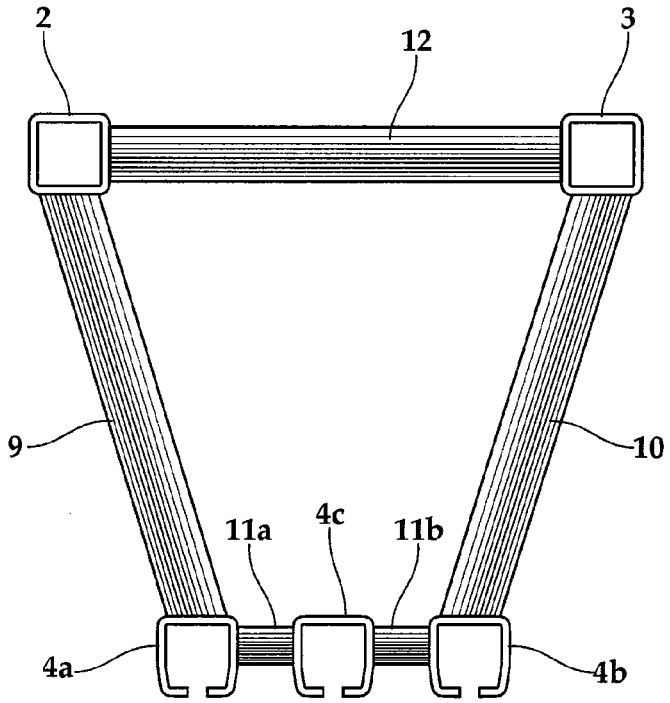
Figure 9:
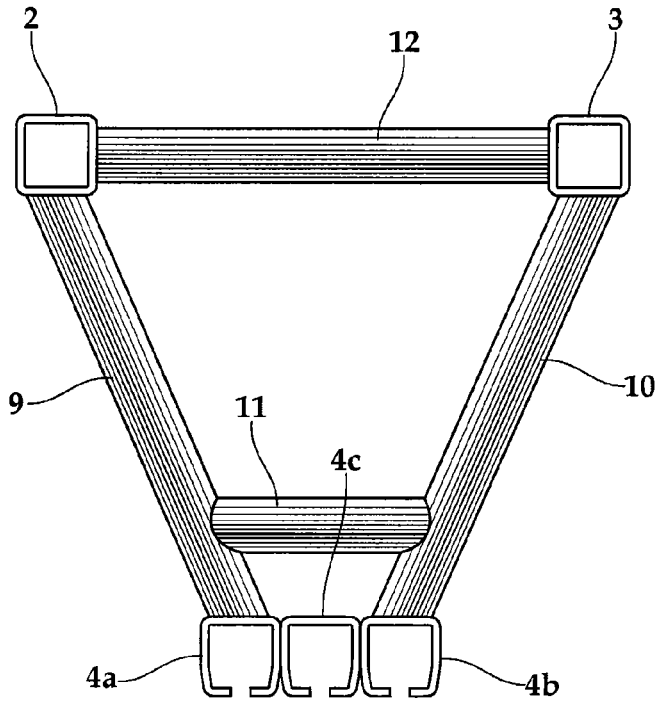

In other alternate embodiments, depicted in FIGS. 8 and 9, a fall protection system 1 includes three housings 4 and some combination of truss members 2 and 3, connecting members 9 and 10, and cross members 11 and 12. FIG. 8 depicts the connecting members 9 and 10 having a trapezoidal shape. Connecting member 9 is directly connected to truss member 2 at one end and to a first housing 4*a* at the other end. Connecting member 10 is directly connected to truss member 3 at one end and to a second housing 4*b* at the other end. A third housing 4*c* is located between the first housing 4*a* and second housing 4*b*. Third housing 4*c* is connected to first housing 4*a* by a first cross member 11*a*. Second housing 4*b* is connected to third housing 4*c* by a second cross member 11*b*. FIG. 9 depicts the connecting members 9 and 10 having a trapezoidal shape including a cross member 11. Connecting member 9 is directly connected to truss member 2 at one end and to a first housing 4*a* at the other end. Connecting member 10 is directly connected to truss member 3 at one end and to a second housing 4*b* at the other end. A third housing 4*c* is located between the first housing 4*a* and second housing 4*b*. Third housing 4*c* is directly connected to first housing 4*a* and second housing 4*b*.

While the invention has been described with a limited number of embodiments, these specific embodiments are not intended to limit the scope of the invention as otherwise described and claimed herein. Variations and modifications therefrom exist. For instance, fall protection systems having more than two truss members and/or more than two housings are expressly envisioned. In addition, embodiments of the invention may have one or more advantage over other systems. Advantageously in some embodiments, the connecting members 9 and 10 do not overlap with a substantial width of the side of the truss members 2 or 3. One advantage of at least some embodiments of the fall protection system described herein is the capability of arresting a user's fall with substantially no deflection of the truss members and/or the housings. Embodiments may also provide a fall protection system that can span longer distances than the current systems without the need for frequent supports. Also, at least some of the described fall protection systems may better resist flexing, sagging, drooping, warping or otherwise distorting. By-pass capability is another feature of embodiments of the fall protection system described herein. In such embodiments, users can walk past each other thus increasing productivity and eliminating the requirement to disconnect from the system to pass each other. Another advantage provided by some fall systems described herein is the transmission of forces from the user's fall to the support members in a manner such that the forces are applied substantially colinear with the support members.

Finally, any number disclosed herein should be construed to mean approximate, regardless of whether the word "about" or "approximate" is used in describing the number. The appended claims intend to cover all such variations and modifications as falling within the scope of the invention.

What is claimed is:

1. A fall protection system, comprising:

first and second truss members, wherein the first and second truss members comprising steel tubing, steel bar, or steel rod are positioned at a first distance from each other;

first and second slotted housings, wherein the first and second housings are positioned below the first and second truss members and spaced at a second distance from each other wherein the second distance is shorter than the first distance and the first and second housings are located at substantially the same height along a vertical dimension; wherein the housings comprise steel tubing having a slot at a bottom of the steel tubing along the longitudinal dimension of the tubing, the slot defining a track formed by the flanges adjacent the slot;

a first plurality of connecting members connecting the first truss member to the first housing; wherein the upper ends of the first plurality of connecting members are directly attached to a bottom surface of the first truss member and the lower ends of the first plurality of connecting members are directly attached to the top of the first housing;

a second plurality of connecting members connecting the second truss member to the second housing; wherein the upper ends of the second plurality of connecting members are directly attached to a bottom surface of the second truss member and the lower ends of the second plurality of connecting members are directly attached to the top of the second housing;

a first plurality of cross members directly attached to the first and second truss members and spacing the first and second truss members at the first distance;

a second plurality of cross members directly attached to respective said first and second plurality of connecting members adjacent to but above their lower ends and spacing the first and second housing at the second distance;

a first trolley slideable through the first housing along the first track;

a second trolley slideable through the second housing along the second track;

a first harness, and a first lanyard connecting the first trolley and the first harness; and a second harness, and a second lanyard connecting the second trolley and the second harness.

2. The fall protection system of claim 1, wherein the system has a length ranging from 10 to 2,000 feet.

3. The fall protection system of claim 1, wherein the system has a length ranging from 100 to 1,000 feet.

4. The fall protection system of claim 1, further comprising at least two spaced apart support members configured to attach to the first and second truss members.

5. The fall protection system of claim 4, wherein the support members are spaced at an interval of about 10 to about 250 feet, 100 to about 200 or about 150 to 200 feet.

6. The fall protection system of claim 1, wherein the first and second truss members are supported on at least two support members.

7. The fall protection system of claim 1, wherein the first and second truss members are suspended from at least two support members.

8. The fall protection system of claim 1, wherein at least two support members are free-standing support members, said support members including a substantially vertical portion and an extending portion extending from the vertical portion over a work area.

9. The fall protection system of claim 8, wherein at least two support members are selected from the group consisting of inverted L-gallows, two-track inverted L-gallows, T-gallows, I-gallows, columns or pillars.

* * * * *